US006346042B1

(12) United States Patent
Parker

(10) Patent No.: US 6,346,042 B1
(45) Date of Patent: Feb. 12, 2002

(54) COMBINATION ATTIC HATCH AND RETURN FILTER GRILL

(76) Inventor: Allen W. Parker, 4255 W. Oak Ave., Fullerton, CA (US) 92883

( * ) Notice: Subject to any disclaimer, the term of this patent is extended or adjusted under 35 U.S.C. 154(b) by 0 days.

(21) Appl. No.: 09/735,048

(22) Filed: Dec. 13, 2000

(51) Int. Cl.[7] ..... F24F 3/16
(52) U.S. Cl. ..... 454/354; 55/385.2; 454/233
(58) Field of Search ..... 454/233, 341, 454/354, 355; 55/385.2, 467.1

(56) References Cited

U.S. PATENT DOCUMENTS 2,496,773 A * 2/1950 Brown ..... 454/354 X
2,692,548 A * 10/1954 Knorr
4,928,441 A * 5/1990 Daley
5,735,086 A * 4/1998 Fordahl
5,816,909 A * 10/1998 Wunder ..... 454/355 X
5,863,310 A * 1/1999 Brown et al.

* cited by examiner

*Primary Examiner*—Harold Joyce
(74) *Attorney, Agent, or Firm*—Goldstein Law Offices, P.C.

(57) ABSTRACT

A combination attic hatch and return filter grill including a base member having an open upper end, an open lower end, and a surrounding side wall therebetween. A cover member is coupled with respect to the base member. The cover member has a closed upper end, an open lower end, and a surrounding side wall therebetween. The open lower end is hingedly coupled with the open upper end of the base member. The closed upper end has an annular collar secured thereto and extending upwardly therefrom. The annular collar has an open upper end for coupling with the return.

4 Claims, 2 Drawing Sheets

COMBINATION ATTIC HATCH AND RETURN FILTER GRILL

BACKGROUND OF THE INVENTION

The present invention relates to a combination attic hatch and return filter grill and more particularly pertains to allowing access to an attic from inside a home without having to construct a separate opening.

The use of attic ventilation devices is known in the prior art. More specifically, attic ventilation devices heretofore devised and utilized for the purpose of allowing attic access are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,816,909 to Wunder discloses a combination attic fan and roof hatch device. U.S. Pat. No. 5,735,086 to Fordahl discloses a combination attic access hatch and louver ventilation device.

While these devices fulfill their respective, particular objective and requirements, the aforementioned patents do not describe a combination attic hatch and return filter grill for allowing access to an attic from inside a home without having to construct a separate opening.

In this respect, the combination attic hatch and return filter grill according to the present invention substantially departs from the conventional concepts and designs of the prior art, and in doing so provides an apparatus primarily developed for the purpose of allowing access to an attic from inside a home without having to construct a separate opening.

Therefore, it can be appreciated that there exists a continuing need for a new and improved combination attic hatch and return filter grill which can be used for allowing access to an attic from inside a home without having to construct a separate opening. In this regard, the present invention substantially fulfills this need.

SUMMARY OF THE INVENTION

In the view of the foregoing disadvantages inherent in the known types of attic ventilation devices now present in the prior art, the present invention provides an improved combination attic hatch and return filter grill. As such, the general purpose of the present invention, which will be described subsequently in greater detail, is to provide a new and improved combination attic hatch and return filter grill which has all the advantages of the prior art and none of the disadvantages.

To attain this, the present invention essentially comprises a base member having a generally square configuration. The base member has an open upper end, an open lower end, and a surrounding side wall therebetween. The open lower end has an access door hingedly coupled thereto. A cover member is coupled with respect to the base member. The cover member has a generally square configuration. The cover member has a closed upper end, an open lower end, and a surrounding side wall therebetween. The open lower end is hingedly coupled with the open upper end of the base member whereby in a closed orientation, the open lower end receives the open upper end of the base member therein. The closed upper end has an annular collar secured thereto and extending upwardly therefrom. The annular collar has an open upper end for coupling with the return.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination attic hatch and return filter grill which has all the advantages of the prior art attic ventilation devices and none of the disadvantages.

It is another object of the present invention to provide a new and improved combination attic hatch and return filter grill which may be easily and efficiently manufactured and marketed.

It is a further object of the present invention to provide a new and improved combination attic hatch and return filter grill which is of durable and reliable construction.

An even further object of the present invention is to provide a new and improved combination attic hatch and return filter grill which is susceptible of a low cost of manufacture with regard to both materials and labor, and which accordingly is then susceptible of low prices of sale to the consuming public, thereby making such a combination attic hatch and return filter grill economically available to the buying public.

Even still another object of the present invention is to provide a new and improved combination attic hatch and return filter grill for allowing access to an attic from inside a home without having to construct a separate opening.

Lastly, it is an object of the present invention to provide a new and improved combination attic hatch and return filter grill including a base member having an open upper end, an open lower end, and a surrounding side wall therebetween. A cover member is coupled with respect to the base member. The cover member has a closed upper end, an open lower end, and a surrounding side wall therebetween. The open lower end is hingedly coupled with the open upper end of the base member. The closed upper end has an annular collar secured thereto and extending upwardly therefrom. The annular collar has an open upper end for coupling with the return.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
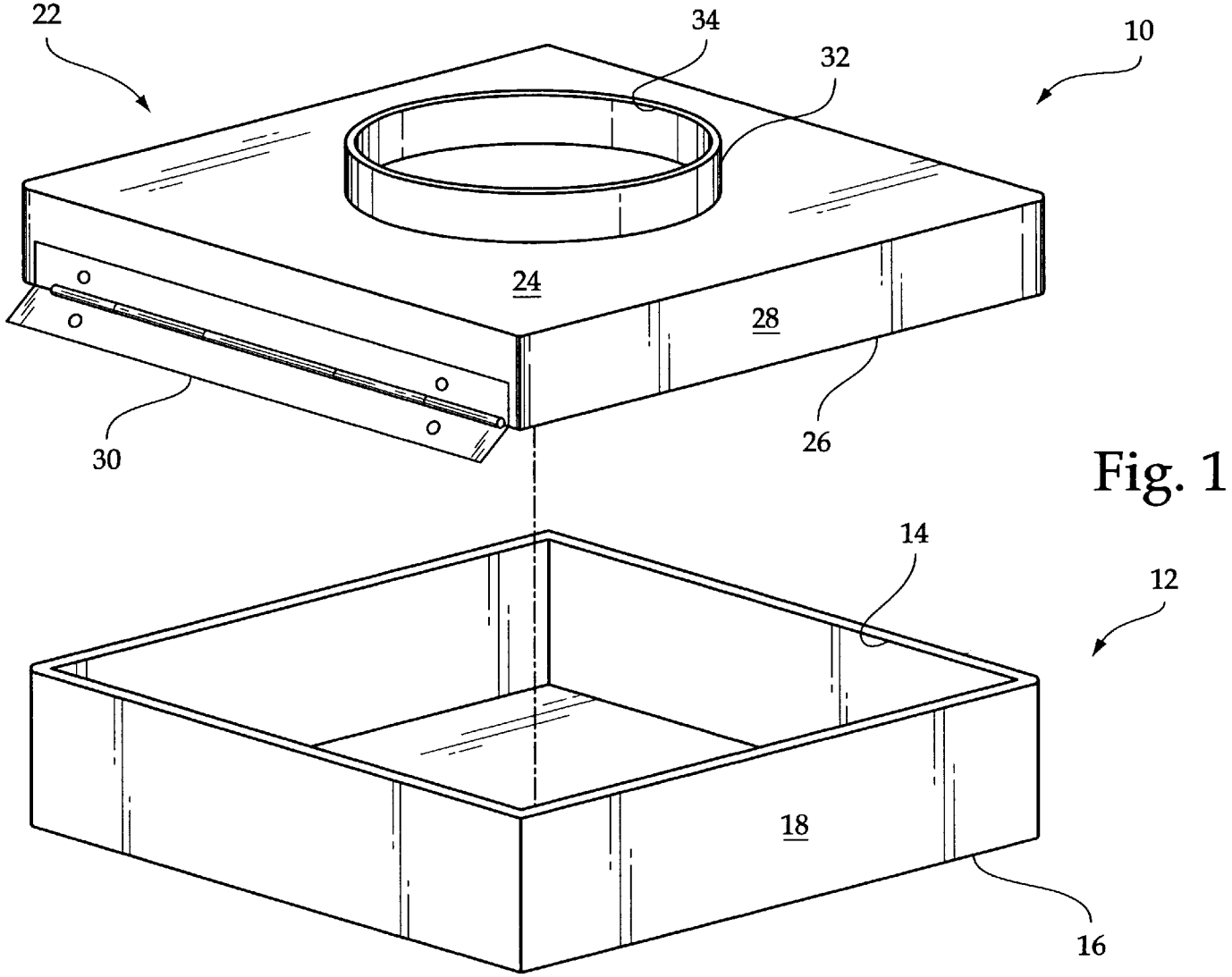
FIG. 1 is a perspective view of the preferred embodiment of the combination attic hatch and return filter grill constructed in accordance with the principles of the present invention.
Figure 2:
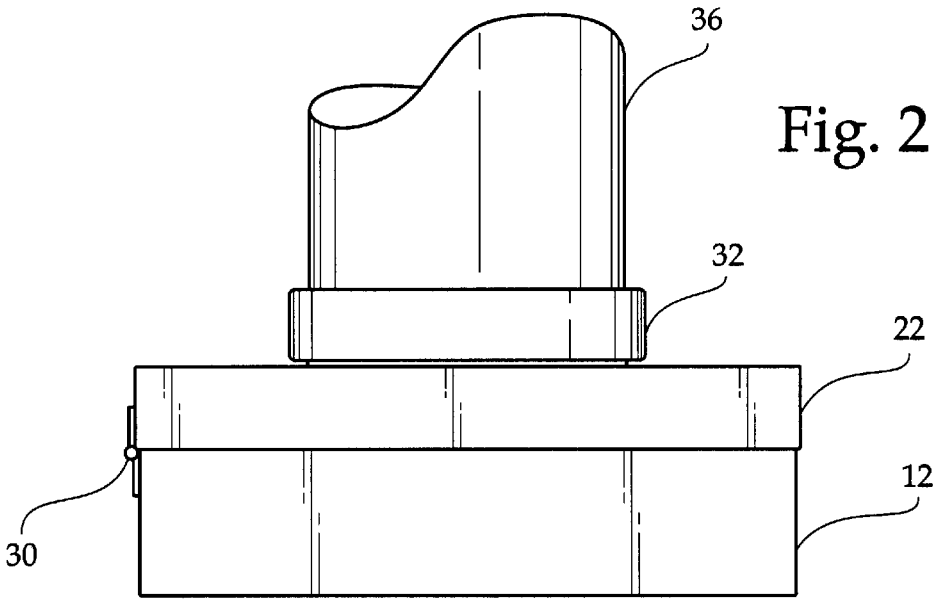
FIG. 2 is a side view of the present invention illustrated coupled with a return.
Figure 3:
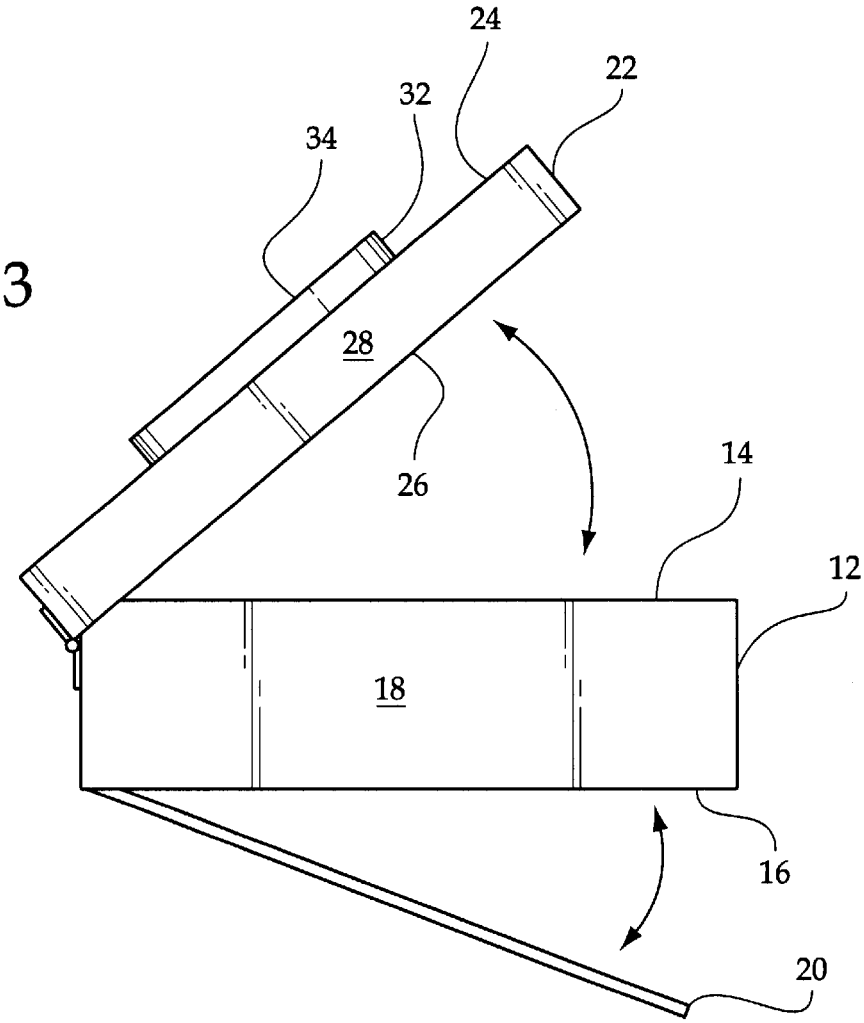
FIG. 3 is a side view of the present invention illustrated in an open orientation.

With reference now to the drawings, and in particular, to FIGS. 1 through 3 thereof, the preferred embodiment of the new and improved combination attic hatch and return filter grill embodying the principles and concepts of the present invention and generally designated by the reference number 10 will be described.

Specifically, it will be noted in the various figures that the device relates to a combination attic hatch and return filter grill for allowing access to an attic from inside a home without having to construct a separate opening. In its broadest context, the device consists of a base member and a cover member. Such components are individually configured and correlated with respect to each other so as to attain the desired objective.

The base member 12 has a generally square configuration. The base member 12 has an open upper end 14, an open lower end 16, and a surrounding side wall 18 therebetween. The open lower end 16 has an access door 20 hingedly coupled thereto. The preferable construction of the base member 12 would be metal, although a wood or rigid plastic could also be utilized.

The cover member 22 is coupled with respect to the base member 12. The cover member 22 has a generally square configuration. The cover member 22 has a closed upper end 24, an open lower end 26, and a surrounding side wall 28 therebetween. The open lower end 26 is hingedly coupled with the open upper end 14 of the base member 12 whereby in a closed orientation, the open lower end 26 receives the open upper end 14 of the base member 12 therein. Note FIG. 2. The hinge coupling is achieved utilizing a piano hinge 30. The closed upper end 24 has an annular collar 32 secured thereto and extending upwardly therefrom. The annular collar 32 has an open upper end 34 for coupling with the return 36. Note FIG. 2.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination attic hatch and return filter grill for allowing access to an attic and a return from inside a home without having to construct a separate opening comprising, in combination:

a base member having a generally square configuration, the base member having an open upper end, an open lower end, and a surrounding side wall therebetween, the open lower end having an access door hingedly coupled thereto; and a cover member coupled with respect to the base member, the cover member having a generally square configuration, the cover member having a closed upper end, an open lower end, and a surrounding side wall therebetween, the open lower end of the cover member being hingedly coupled with the open upper end of the base member whereby in a closed orientation, the open lower end of the cover member receives the open upper end of the base member therein, the closed upper end having an annular collar secured thereto and extending upwardly therefrom, the annular collar having an open upper end for coupling with the return.

2. A combination attic hatch and return filter grill for allowing access to an attic and a return from inside a home without having to construct a separate opening comprising, in combination:

a base member having an open upper end, an open lower end, and a surrounding side wall therebetween; and a cover member coupled with respect to the base member, the cover member having a closed upper end, an open lower end, and a surrounding side wall therebetween, the open lower end being hingedly coupled with the open upper end of the base member, the closed upper end having an annular collar secured thereto and extending upwardly therefrom, the annular collar having an open upper end for coupling with the return.

3. The combination attic hatch and return filter grill as set forth in claim 2, wherein the open lower end of the base member has an access door hingedly coupled thereto.

4. The combination attic hatch and return filter grill as set forth in claim 2, wherein the open lower end of the cover member is hingedly coupled with the open upper end of the base member whereby in a closed orientation, the open lower end of the cover member receives the open upper end of the base member therein.

* * * * *